US010018942B2

(12) United States Patent
Makie

(10) Patent No.: US 10,018,942 B2
(45) Date of Patent: Jul. 10, 2018

(54) DEVELOPING DEVICE AND IMAGE FORMING APPARATUS

(71) Applicant: KYOCERA Document Solutions Inc., Osaka (JP)

(72) Inventor: Ikuo Makie, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/494,113

(22) Filed: Apr. 21, 2017

(65) Prior Publication Data

US 2017/0322505 A1 Nov. 9, 2017

(30) Foreign Application Priority Data

May 9, 2016 (JP) ..... 2016-093679

(51) Int. Cl.
*G03G 15/08* (2006.01)

(52) U.S. Cl.
CPC ..... *G03G 15/0889* (2013.01); *G03G 15/0891* (2013.01); *G03G 15/0896* (2013.01); *G03G 2215/0872* (2013.01)

(58) Field of Classification Search
CPC ..... G03G 15/08; G03G 15/0806; G03G 15/0808; G03G 15/0887; G03G 15/0889; G03G 15/0891; G03G 15/0896; G03G 2215/0802; G03G 2215/0827; G03G 2215/0872
USPC ..... 399/252, 254, 255, 256
See application file for complete search history.

(56) References Cited

U.S. PATENT DOCUMENTS 5,963,766 A * 10/1999 Okuno ..... G03G 15/0822 399/254
2012/0189349 A1* 7/2012 Okuno ..... G03G 15/0189 399/254
2012/0321352 A1* 12/2012 Iida ..... G03G 15/0893 399/254
2016/0062274 A1* 3/2016 Kadota ..... G03G 15/0891 399/254

FOREIGN PATENT DOCUMENTS

JP 2004-151340 A 5/2004

OTHER PUBLICATIONS

"Roughness Parameters," Rubert & Co Ltd, http://www.rubert.co.uk/faqs/roughness-parameters/.*

* cited by examiner

*Primary Examiner* — Benjamin Schmitt
(74) *Attorney, Agent, or Firm* — Stein IP, LLC

(57) ABSTRACT

A developing device has a developer container, a first stirring member, and a first stirring chamber. The developer container stores toner. The first stirring member conveys toner while stirring it. The first stirring chamber is in the developer container. The first stirring member is in the first stirring chamber. In a top surface of the first stirring member is a toner supply port through which toner is supplied from outside by action of gravity. The first stirring member has, on the downstream side of the toner supply port in the toner conveying direction, a reduced conveying power portion exerting reduced conveying power to toner. The first stirring chamber has a developer stagnation portion at a position facing the reduced conveying power portion. The inner surface of the developer stagnation portion has a smaller surface roughness than the inner surface of the stirring chamber except for the developer stagnation portion.

6 Claims, 3 Drawing Sheets

DEVELOPING DEVICE AND IMAGE FORMING APPARATUS

INCORPORATION BY REFERENCE

This application is based upon and claims the benefit of priority from the corresponding Japanese Patent Application No. 2016-093679 filed on May 9, 2016, the entire contents of which are incorporated herein by reference.

BACKGROUND

The present disclosure relates to a developing device and to an image forming apparatus incorporating the developing device.

In image forming apparatuses exploiting electrophotography, such as copiers and printers, a device is widely used that forms a toner image on a sheet by developing in a developing device an electrostatic latent image formed on the surface of a photosensitive drum as an image carrying member. Some developing devices adopt a method in which toner is supplied as it is consumed.

Here, a developing device is known that has a developer chamber for stirring and mixing toner, a stirring/conveying member arranged in the developer chamber, and a toner inlet provided in a top surface of the developer chamber. Toner is supplied via the toner inlet into the developer chamber by the action of gravity. The stirring/conveying member has, in a part thereof under the toner inlet, a region which exerts reduced conveying power. With this configuration, in the region of the stirring/conveying member which exerts reduced conveying power, a balance is kept between the pressure of the toner moving toward the toner inlet and the pressure of the toner supplied from the toner inlet, and thus toner is supplied automatically as it is consumed.

SUMMARY

According to one aspect of the present disclosure, a developing device has a developer container, a stirring member, and a stirring chamber. The developer container stores developer to be fed to an image carrying member. The stirring member is rotatably supported in the developer container, and conveys, while stirring, developer along the axial direction of its rotary shaft. The stirring chamber is arranged in the developer container, and has the stirring member arranged in it. Moreover, the stirring chamber has a developer supply port arranged in its top surface for receiving developer supplied from outside by the action of gravity. The stirring member has a reduced conveying power portion which is arranged on the downstream side of the developer supply port in the conveyance direction of developer in the stirring chamber and which exerts reduced conveying power to the developer. The stirring chamber has a developer stagnation portion arranged at a position facing the reduced conveying power portion, and in the stirring chamber, an inner surface of the developer stagnation portion has a smaller surface roughness than a surface roughness of an inner surface of the string chamber except for the developer stagnation portion.

DETAILED DESCRIPTION

Hereinafter, an embodiment of the present disclosure will be described with reference to the accompanying drawings. The present disclosure is not limited to what is disclosed herein.

Figure 1:
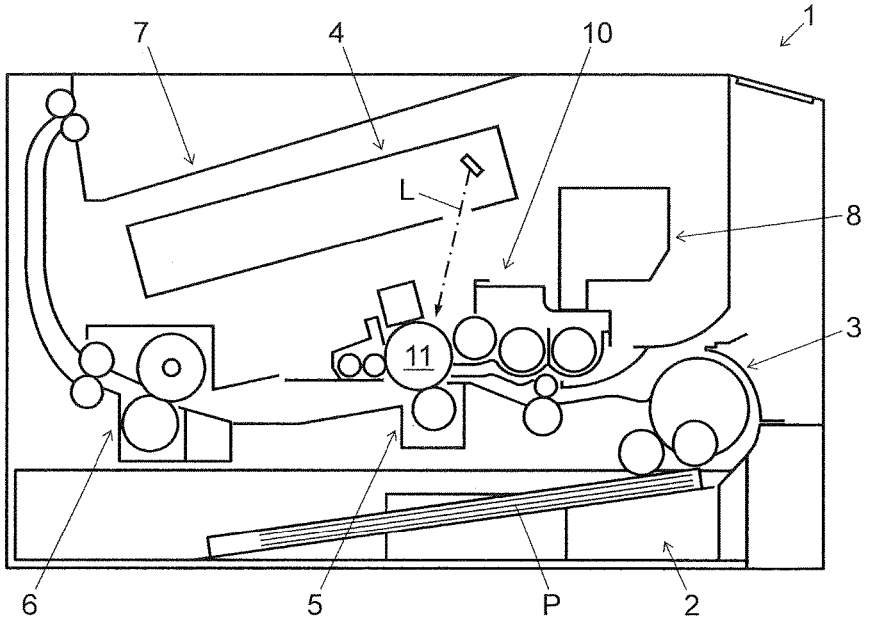
FIG. 1 is a sectional view showing an outline of the structure of an image forming apparatus according to an embodiment of the present disclosure.
Figure 2:
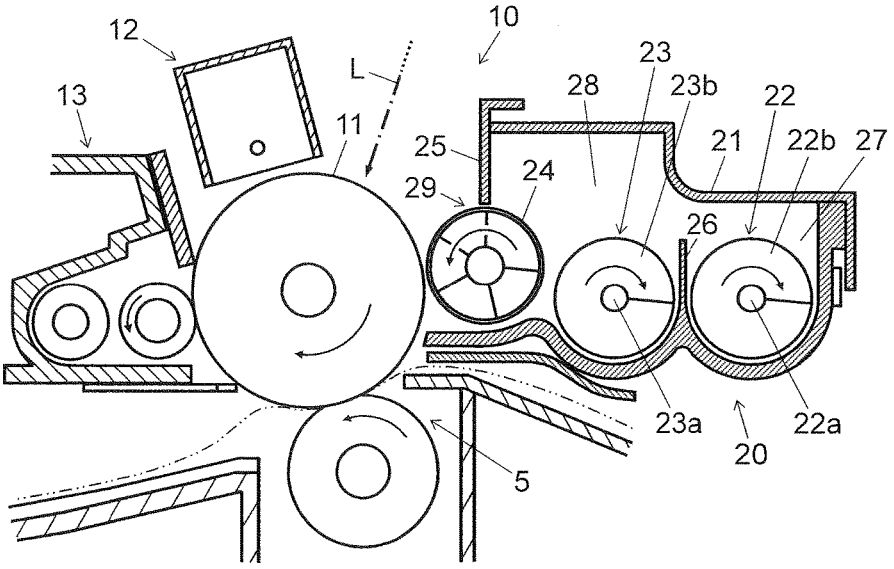
FIG. 2 is a sectional view showing the structure of an image forming portion in the image forming apparatus according to the embodiment of the present disclosure.

First, as to an image forming apparatus according to an embodiment of the present disclosure, an outline of its structure will be described with reference to FIGS. 1 and 2. FIG. 1 is an exemplary sectional view showing an outline of the structure of an image forming apparatus. FIG. 2 is a sectional view showing the structure of an image forming portion in the image forming apparatus. The image forming apparatus 1 is a so-called printer that performs printing on receiving an instruction for a print job from, for example, an external computer. The image forming apparatus 1 receives signals representing image data and a job instruction from the computer.

As shown in FIG. 1, the image forming apparatus 1 includes a sheet feeding portion 2, a sheet conveying portion 3, an exposure portion 4, an image forming portion 10, a toner supplying device 8, a transfer portion 5, and a fixing portion 6.

The sheet feeding portion 2 stores a plurality of sheets P, and feeds them separately one sheet after another during printing. The sheet conveying portion 3 conveys a sheet P fed out from the sheet feeding portion 2 to the transfer portion 5 and then to the fixing portion 6, and discharges the sheet P having undergone fixing onto a sheet discharge portion 7 of the apparatus. The exposure portion 4 radiates laser light L controlled based on the image data toward the image forming portion 10.

As shown in FIG. 2, in the image forming portion 10, around a photosensitive drum 11, which is an image carrying member supported so as to be rotatable in a predetermined direction (the clockwise direction in FIG. 2), along its rotation direction, there are arranged a charging portion 12, a developing device 20, and a cleaning portion 13. The transfer portion 5 is arranged between the developing device 20 and the cleaning portion 13. The toner supplying device 8 is arranged over the developing device 20, and supplies toner to the developing device 20 by use of the action of gravity.

The charging portion 12 electrostatically charges the surface of the photosensitive drum 11 to a predetermined potential, for example, by corona discharge. Then, by the laser light L emitted from the exposure portion 4, an electrostatic latent image based on a document image is formed on the surface of the photosensitive drum 11. The developing device 20 feeds toner to the electrostatic latent image and develops it, thereby forming a toner image.

The transfer portion 5 transfers the toner image on the surface of the photosensitive drum 11 to the sheet P. After the transfer, the cleaning portion 13 removes deposits such as toner that remain attached to the surface of the photosensitive drum 11. The fixing portion 6 heats and presses the sheet P having the toner image transferred to it, and thereby fixes the toner image to the sheet P.

Now, the overall structure of the developing device 20 in the image forming portion 10 will be described with reference to FIG. 2.

As shown in FIG. 2, the developing device 20 includes a developer container 21, a first stirring member 22, a second stirring member 23, a developing roller 24, and a regulating blade 25.

The developer container 21 is a container for storing one-component or two-component developer as developer to be fed to the photosensitive drum 11 which is an image carrying member. In the following description, developer is occasionally referred to as "toner". The developer container 21, for example, is formed of synthetic resin and is formed as a synthetic resin molding. The developer container 21 has a shape elongated in the axial direction of the photosensitive drum 11, and is arranged with its longitudinal direction aligned horizontally.

The developer container 21 has inside it a first stirring chamber 27 and a second stirring chamber 28 partitioned by a partition wall 26. The second stirring chamber 28 is arranged next to a region where the developing roller 24 is arranged. The first stirring chamber 27 is arranged in a region away from the developing roller 24 across the second stirring chamber 28. The first stirring chamber 27 has a toner supply port 27*a* (unillustrated in FIG. 2; see FIG. 4), through which toner is supplied from the toner supplying device 8 shown in FIG. 1.

The first stirring member 22 is arranged in the first stirring chamber 27. The first stirring member 22 is composed of a conveying blade 22*b* spirally extending, along the axial direction, on the circumferential surface of a rotary shaft 22*a* arranged between opposite ends in the axial direction. The first stirring member 22 is supported on the developer container 21 so as to be rotatable about its axis extending in the horizontal direction. The first stirring member 22 rotates clockwise in FIG. 2, and conveys toner, while stirring it, along the axial direction of its rotary shaft. By the rotation of the first stirring member 22, the toner supplied from the toner supplying device 8 into the first stirring chamber 27 is guided into the second stirring chamber 28.

The second stirring member 23 is arranged in the second stirring chamber 28. The second stirring member 23 is composed of a conveying blade 23*b* spirally extending, along the axial direction, on the circumferential surface of a rotary shaft 23*a* arranged between both ends in the axial direction. The second stirring member 23 is supported on the developer container 21 so as to be rotatable about its axis extending in the horizontal direction. The second stirring member 23 rotates clockwise in FIG. 2, and conveys toner, while stirring it, along the axial direction of its rotary shaft. By the rotation of the second stirring member 23, the toner guided from the first stirring chamber 27 into the second stirring chamber 28 is fed to the developing roller 24.

The developing roller 24 is a developer carrying member arranged in a photosensitive drum 11-side region of the second stirring chamber 28. The developer container 21 has an opening 29 in a part thereof next to the photosensitive drum 11. The developing roller 24 faces this opening 29, and is supported on the developer container 21 so as to be rotatable about its axis extending in the horizontal direction. The developer roller 24 rotates counter-clockwise in FIG. 2. The developer roller 24 has one part of its circumferential surface arranged inside the developer container 21 and another part of it exposed to the outside through the opening 29 to face the photosensitive drum 11.

The developing roller 24 is, for example, formed as a magnet roller having fixed inside it a magnetic field producing member (unillustrated) comprising a permanent magnet. With the magnetic force of this magnetic field producing member, the developer roller 24 carries on its surface toner, in the form of a thin layer, to be fed to the surface of the photosensitive drum 11.

The developing roller 24, the first stirring member 22, and the second stirring member 23 are rotatably supported on the developer container 21, parallel to one another. The developing roller 24, the first stirring member 22, and the second stirring member 23 are driven to rotate by an unillustrated motor.

The regulating blade 25 is arranged in the opening 29, close to the developing roller 24 such that a tip end of the regulating blade 25 faces the surface of the developing roller 24. The regulating blade 25 is arranged, with respect to the rotation direction of the developing roller 24, on the upstream side of the region where the developing roller 24 faces the photosensitive drum 11. The regulating blade 25 is arranged with a predetermined interval left between its tip end and the surface of the developing roller 24. The regulating blade 25 is a regulating member which regulates the amount of toner carried on the surface of the developing roller 24.

The regulating blade 25 is, for example, formed of magnetic stainless steel such as SUS 430. By the magnetic field producing member of the developing roller 24 arranged opposite a tip end of the regulating blade 25, a magnetic field is produced between the developing roller 24 and the regulating blade 25. Thus, not only by the interval between the regulating blade 25 and the developing roller 24 but also by the strength of the magnetic field, the amount of toner that attaches to the developing roller 24 is strictly controlled. This makes it possible to form a toner layer as thin as several tens of microns.

Figure 3:
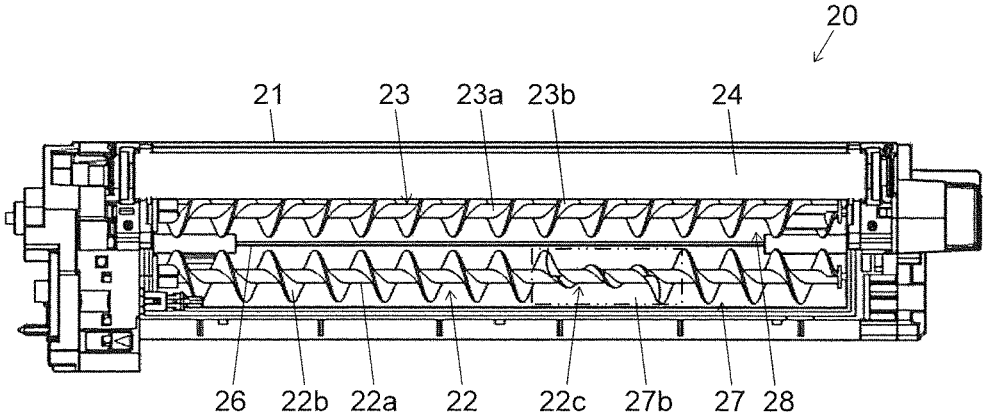
FIG. 3 is a horizontal sectional view of a developing device in the image forming apparatus according to the embodiment of the present disclosure.
Figure 4:
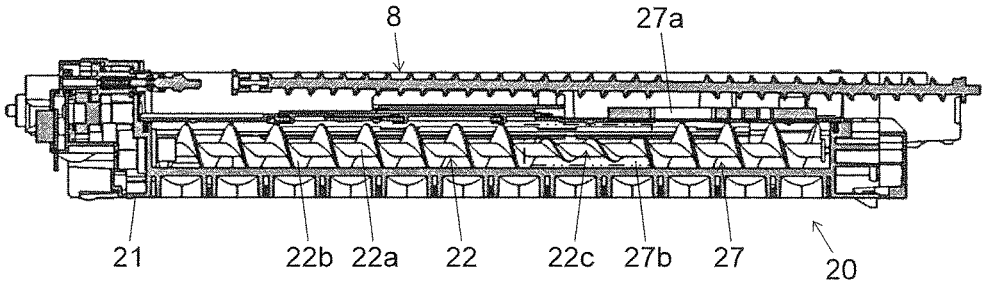
FIG. 4 is a vertical sectional view of the developing device in the image forming apparatus according to the embodiment of the present disclosure.

Now, the structure of the developing device 20 will be described in detail with reference to FIGS. 3 and 4 along with FIGS. 1 and 2. FIGS. 3 and 4 are a horizontal sectional view and a vertical sectional view, respectively, of the developing device 20.

As shown in FIG. 4, the first stirring chamber 27 has the toner supply port 27*a* which is a developer supply port. The toner supply port 27*a* is arranged in a top surface of the first stirring chamber 27, and communicates with the interior of the toner supplying device 8. The first stirring chamber 27 receives, via the toner supply port 27*a*, toner supplied from the toner supplying device 8 by the action of gravity. The toner supplying device 8 constantly supplies toner to the first stirring chamber 27.

As shown in FIGS. 3 and 4, the first stirring member 22 has a reduced conveying power portion 22*c*. The reduced conveying power portion 22*c* is arranged on the downstream side of the toner supply port 27*a* in the conveyance direction of toner inside the first stirring chamber 27. In the reduced conveying power portion 22*c*, the outer diameter of the conveying blade 22*b* is smaller than in the rest of the first stirring member 22. Thus, the reduced conveying power portion 22*c* exerts reduced conveying power to toner as compared with the rest of the first stirring member 22.

The first stirring chamber 27 has a developer stagnation portion 27*b* indicated by the dash-dot-dot line in FIGS. 3 and 4. The developer stagnation portion 27*b* is arranged at a position facing the reduced conveying power portion 22*c*. The arithmetic average roughness of the inner surface of the developer stagnation portion 27*b* is, for example, 0.1 μm or less. The roughness of the inner surface of the developer stagnation portion 27*b* can be produced, for example, when the developer container 21 is molded.

The arithmetic average roughness of the inner surface of the first stirring chamber 27 except for the developer stagnation portion 27*b* is, for example, 1.0 μm or more. That is, the inner surface of the developer stagnation portion 27*b* has a smaller surface roughness than that of the inner surface of the first stirring chamber 27 except for the developer stagnation portion 27*b*. Here, a configuration is also possible where the inner surface of the developer stagnation portion 27*b* has a smaller surface roughness than that of the inner surface of the entire developer container 21 except for the developer stagnation portion 27*b*. The roughness of the inner surface except for the developer stagnation portion 27*b* can be produced through surface treatment, for example, by blasting. Hereinafter, of the inner surface of the developer container 21, the part except for the developer stagnation portion 27*b* having an arithmetic average roughness of 1.0 or more is occasionally referred to as a "coarse surface region".

Figure 5:
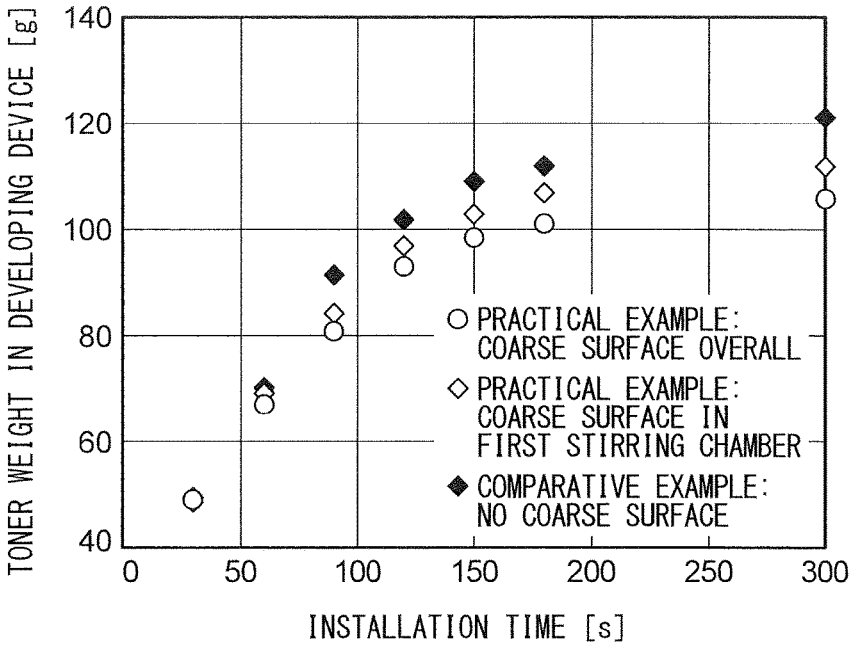
FIG. 5 is a diagram showing how the weight of toner varies, during installation of toner until it is completed, in the developing device according to the embodiment of the present disclosure.
Figure 6:
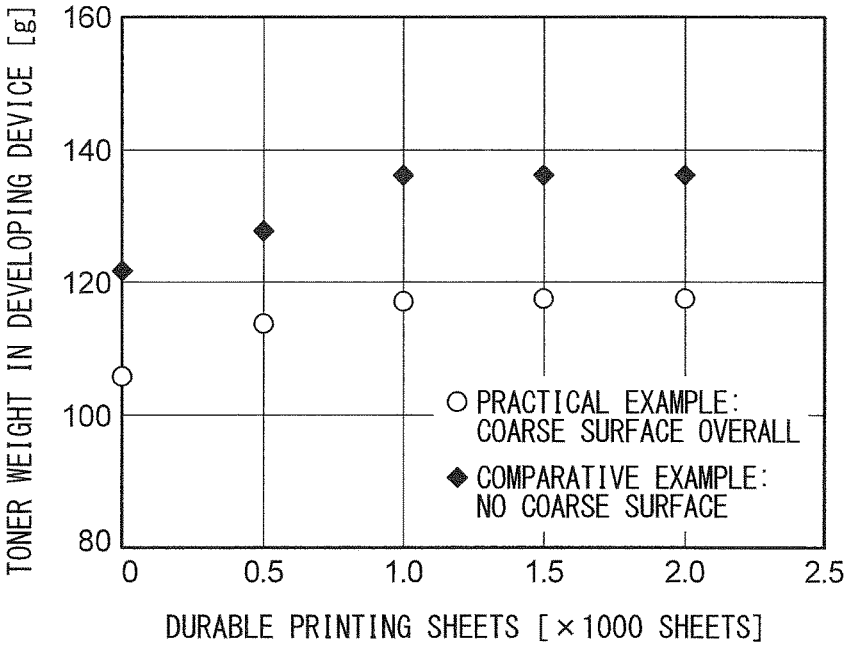
FIG. 6 is a diagram showing the relationship between the durable printing period and the weight of toner in the developing device according to the embodiment of the present disclosure.

Now, as to this embodiment, an evaluation of the circulation of toner achieved in developing devices according to Practical Example and Comparative Example will be described with reference to FIGS. 5 and 6. FIG. 5 is a diagram showing how the weight of toner varied, during installation of toner until it was completed, in the developing devices according to Practical Example and Comparative Example. FIG. 6 is a diagram showing the relationship between the durable printing period and the weight of toner in the developing devices according to Practical Example and Comparative Example.

In FIG. 5, the vertical axis represents the weight of toner in the developing devices and the horizontal axis represents time. With the developing device 20 of Practical Example, the circulation of toner was evaluated when, with respect to the developer stagnation portion 27*b* of which the inner surface had an arithmetic average roughness of 0.1, the coarse surface region (with an arithmetic average roughness of 1.04) was the inner surface of only the first stirring chamber 27 except for the developer stagnation portion 27*b* and when it was the inner surface of the entire developer container 21 except for the developer stagnation portion 27*b*. With the developing device of Comparative Example, in which there was no coarse surface region in the entire developer container, the circulation of toner was evaluated when the inner surface of the entire developer container had an arithmetic average roughness of 0.1.

FIG. 5 confirms that the weight of toner that remained after installation in the developing device 20 of Practical Example was smaller than that in the developing device of Comparative Example. That is, it can be said that the developing device 20 of Practical Example provides improved toner slippage and increased toner conveying power, preventing supply of more than necessary toner to the developing device 20.

In FIG. 6, the vertical axis represents the weight of toner in the developing devices and the horizontal axis presents the number of printed sheets. With the developing device 20 of Practical Example, the circulation of toner was evaluated when, with respect to the developer stagnation portion 27*b* of which the inner surface had an arithmetic average roughness of 0.1, the coarse surface region (with an arithmetic average roughness of 1.04) was the inner surface of the entire developer container 21 except for the developer stagnation portion 27*b*. With the developing device of Comparative Example, in which there was no coarse surface region in the entire developer container, the circulation of toner was evaluated when the inner surface of the entire developer container had an arithmetic average roughness of 0.1.

For the evaluation of the circulation of toner shown in FIG. 6, the same developing devices having installed toner for the evaluation of the circulation of toner shown in FIG. 5 were used. Thus, when the number of printed sheets was zero, the weight of toner in the developing device of Practical Example was different from that in the developing device of Comparative Example.

FIG. 6 confirms that the developing device 20 of Practical Example had a lower increase rate of the weight of toner in the developing device in the durable printing period than that of the developing device of Comparative Example. For example, the weight of toner increased during durable printing of up to 2000 sheets in the developing device 20 of Practical Example is smaller than in the developing device in Comparative Example. That is, it can be said that the developing device 20 of Practical Example provides improved toner slippage and increased toner conveying power, preventing supply of more than necessary toner to the developing device 20.

As in the above-described embodiment, in the developing device 20, the first stirring chamber 27 has the developer stagnation portion 27*b* arranged at a position facing the reduced conveying power portion 22*c* of the first stirring member 22, and the inner surface of the developer stagnation portion 27*b* has a smaller surface roughness than that of the inner surface except for the developer stagnation portion 27*b*.

Toner attaches to the inner surface of the developer container 21 more easily the closer to a so-called mirror finish state the inner surface of the developer container 21 is, in which state it has a comparatively small surface roughness. Thus, with the above-mentioned configuration, toner is more likely to stay in the developer stagnation portion 27*b*. On the other hand, owing to the inner surface having a larger surface roughness except in the developer stagnation portion 27*b* than in the developer stagnation portion 27*b*, it is possible to obtain improved toner slippage and increased toner conveying power. Thus, it is possible to suitably keep the balance between the pressure of the toner moving toward the toner supply port 27*a* in the developer container 21 and the pressure of the toner supplied from the toner supply port 27*a* into the developer container 21. Thus, automatic supply of toner by the action of gravity can be suitably achieved.

In the developing device 20, owing to the inner surface of the developer stagnation portion 27*b* having an arithmetic average roughness of 0.1 or less, it is possible to easily make toner more likely to stay in the developer stagnation portion 27*b*.

In the developing device 20, the inner surface of the developer stagnation portion 27*b* has a smaller surface roughness than that of the inner surface of the first stirring chamber 27 except for the developer stagnation portion 27*b*. This permits the developing device 20 to provide improved toner slippage and increased toner conveying power in the first stirring chamber 27 except for the developer stagnation portion 27*b*.

In the developer container 21, the inner surface of the developer stagnation portion 27*b* has a smaller surface roughness than that of the inner surface of the entire developer container 21 except for the developer stagnation portion 27*b*. This permits the developer container 21 to provide improved toner slippage and increased toner conveying power in the entire developer container 21 except for the developer stagnation portion 27*b*.

In the developer container 21, the inner surface except in the developer stagnation portion 27*b* has an arithmetic average roughness of 1.0 or more, and this makes it possible to easily obtain improved toner slippage and increased toner conveying power in the part except for the developer stagnation portion 27*b*.

In the reduced conveying power portion 22*c*, the outer diameter of the conveying blade 22*b* is smaller than in the rest of the first stirring member 22, and thus the reduced conveying power portion 22*c* exerts reduced conveying power to toner as compared with the rest of the first stirring member 22. Thus, the developing device 20 can effectively make toner more likely to stay in the developer stagnation portion 27*b*.

In this embodiment, the developing device 20 configured as described above is incorporated in the image forming apparatus 1.

With this configuration, in the image forming apparatus 1, automatic supply of toner to the developing device 20 by the action of gravity can be suitably achieved.

The embodiments of the present disclosure described above are in no way meant to limit the scope of the present disclosure, which thus allows for many modifications and variations within the spirit of the present invention.

What is claimed is:

1. A developing device comprising:

a developer container which stores developer to be fed to an image carrying member;

a stirring member rotatably supported in the developer container, the stirring member conveying, while stirring, developer along an axial direction of a rotary shaft thereof; and a stirring chamber arranged in the developer container, the stirring chamber having the stirring member arranged therein, wherein the stirring chamber has a developer supply port arranged in a top surface thereof for receiving developer supplied from outside by action of gravity, the stirring member has a reduced conveying power portion which is arranged on a downstream side of the developer supply port in a conveyance direction of developer in the stirring chamber and which exerts reduced conveying power to the developer, and the stirring chamber has a developer stagnation portion arranged at a position facing the reduced conveying power portion, and in the stirring chamber, an inner surface of the developer stagnation portion has a smaller surface roughness than a surface roughness of an inner surface of the stirring chamber except for the developer stagnation portion.

2. The developing device of claim 1, wherein the inner surface of the developer stagnation portion has an arithmetic average roughness Ra of 0.1 μm or lower.

3. The developing device of claim 1, wherein the inner surface of the developer stagnation portion has a smaller surface roughness than a surface roughness of an inner surface of the entire developer container except for the developer stagnation portion.

4. The developing device of claim 1, wherein the inner surface except for the developer stagnation portion has an arithmetic average roughness Ra of 1.0 μm or more.

5. The developing device of claim 1, wherein the stirring member has a rotary shaft and a conveying blade arranged around a circumferential surface of the rotary shaft, and in the reduced conveying power portion, an outer diameter of the conveying blade is smaller than an outer diameter of the conveying blade in another part of the stirring member.

6. An image forming apparatus comprising the developing device of claim 1.

* * * * *